US005160748A

United States Patent [19]

Gauuan

[11] Patent Number: 5,160,748

[45] Date of Patent: Nov. 3, 1992

[54] DUAL CONCRETE EDGING TOOL

[75] Inventor: Jim Gauuan, Stockton, Calif.

[73] Assignee: Gauuan Construction Co., Inc., Stockton, Calif.

[21] Appl. No.: 615,318

[22] Filed: Nov. 19, 1990

[51] Int. Cl.[5] ..... B28B 11/08; B28B 1/29

[52] U.S. Cl. ..... 425/458; 15/235.4; 15/235.8

[58] Field of Search ..... 425/458; 15/235.3, 235.4, 15/235.5, 235.7, 235.8; 404/74, 87, 68, 84, 84.05, 84.1

[56] References Cited

U.S. PATENT DOCUMENTS

| | | | |
|---|---|---|---|
| 761,242 | 5/1904 | Meyers | 15/235.3 |
| 1,027,396 | 5/1912 | Abram | 15/235.3 |
| 1,273,060 | 7/1918 | Hoff | 15/235.7 |
| 2,014,894 | 9/1935 | Heltzel | 404/74 |
| 3,246,390 | 4/1966 | Brown | 29/235 |
| 3,335,647 | 8/1967 | Thorp | 404/87 |
| 3,473,450 | 10/1969 | Koch | 404/87 |
| 3,495,509 | 2/1970 | Lusk | 404/84 |
| 3,605,586 | 9/1971 | Bowman | 404/68 |
| 3,806,268 | 4/1974 | Francis | 15/235.3 |
| 4,155,141 | 5/1979 | Guerra | 15/235.8 |
| 4,397,581 | 8/1983 | Jarvis | 15/235.8 |

OTHER PUBLICATIONS

"Dual Walking Edger", Product Brochure-Stegmeier Corporation, Arlington, Tex., 1984.

*Primary Examiner*—Willard Hoag
*Attorney, Agent, or Firm*—Walter A. Hackler

[57] ABSTRACT

A dual concrete edging tool apparatus comprises first and second, generally conventional edging tools, each of the edging tools comprising a flat plate having a narrow edging lip depending therefrom and a rigid plate, the first and second edging tools being mounted by longitudinal angle irons to the under side of the plate so that both of the edging tools have their depending lips in parallel opposition with one another, one of the edging tools being mounted to transversely-oriented slots in the plate to enable the distance between the depending lips of the first and second edging tools to be adjustably varied from zero inches to at least about two inches. An edging tool back-up element is mounted to the plate to be in contact with upper surfaces of both the first and second edging tool and to thereby enhance the rigidity of the apparatus. The apparatus includes an elontate, pole-like operating handle pivotally mounted to upper regions of the frame in a generally central region thereof.

12 Claims, 1 Drawing Sheet

FIG. 1.
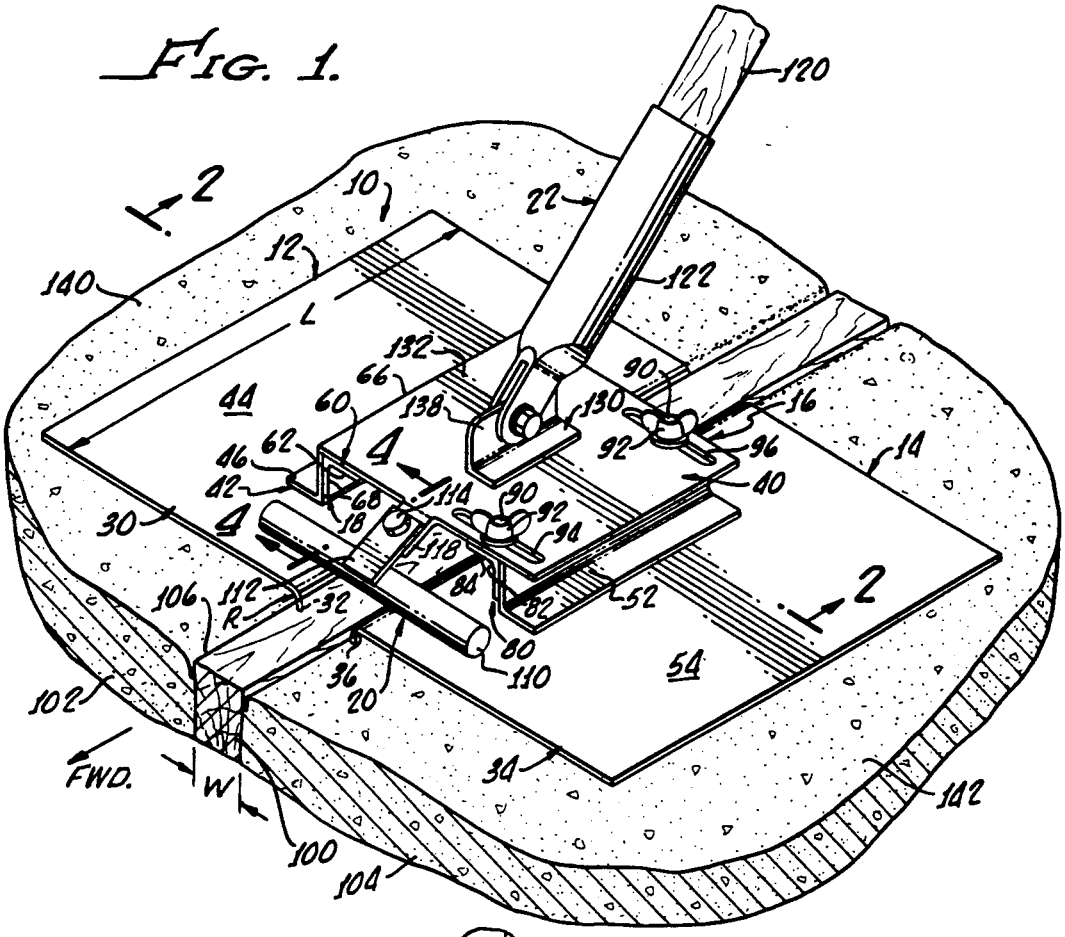
FIG. 2.
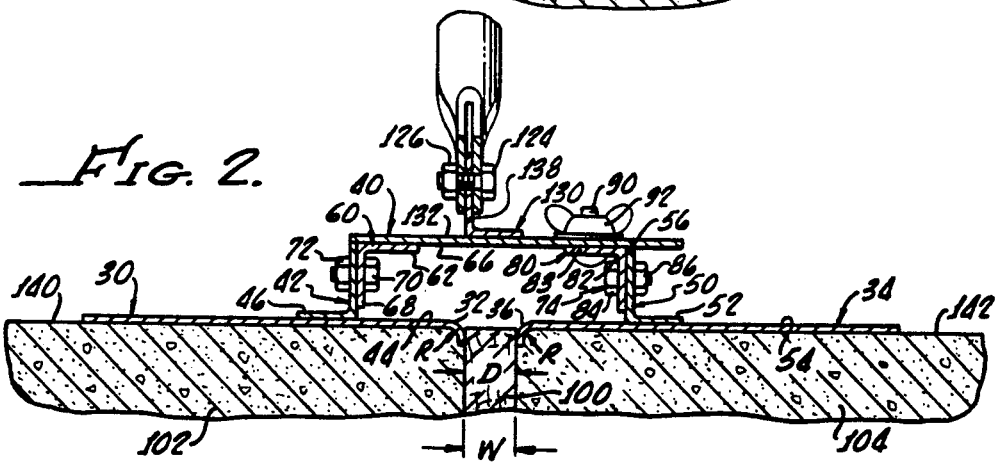
FIG. 3.
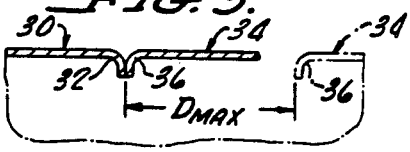
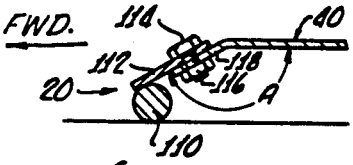
FIG. 4.

DUAL CONCRETE EDGING TOOL

BACKGROUND OF THE INVENTION

1. Field of the Invention

This invention relates generally to the field of concreting tools and, more, particularly to concrete edging tools.

2. Background Discussion

It is well known that after slabs of concrete are poured, for example, for sidewalks, driveways, patios, streets, and highways, and before the concrete hardens, the sharp edges of the still-wet concrete slabs are rounded off with an edging tool. This is done not only for the sake of appearance, but for safety purposes since the edges of the concrete, after the concrete has hardened may be relatively sharp and are capable of injuring anyone who happened to fall against the edges. Moreover, if the edges are left sharp, there is a tendency for the sharp edges to crack off, thereby leaving unsightly regions along the edges of the slabs.

Concrete edging tools for rounding off the edges of concrete slab (before the concrete has hardened) are usually hand-held and usually comprise a rectangle of heavy gauge sheet metal which has been bent over at 90 degrees along one edge region so as to form a short, down-turned leg or lip which is about a half inch wide and leaving a long leg which is several inches wide. The overall length of such an edging tool is usually several inches, for example, about six to eight inches. In use, such edging tools are positioned at an edge of a still-wet concrete slab, with the wide leg in contact with the exposed, upper surface of the slab. The edging tool is positioned so that the narrow leg is along the side edge of the slab. As the tool is drawn or pushed hard along the concrete, the radius portion of the tool between the short and long legs rounds off the hitherto sharp edge of the slab. The edge of the concrete slab which is rounded off in this manner may be along a side edge of the slab or may be along a wood or felt-like divider or expansion joint between adjacent concrete slabs. In other instances an edging tool may be used to create a joint in the slab along which the slab, when hardened, may preferentially crack (and not show), instead of cracking across an unscored region.

Normally such concrete edging tools are constructed having a handle for hand gripping mounted to the long leg portion of the tool. Such a handle arrangement generally requires an individual using the tool to do so from a kneeling position (assuming horizontal concrete slabs). Alternatively, the edging tool may be constructed with a long broomstick-like handle enabling the tool to be used from a standing position.

As can be appreciated, the rounding off of the edges of a concrete slab by the use of such edging tools is usually laborious, often tedious and always time consuming. Concrete sidewalks, streets, patios and other large expanses of concrete in addition to having edges along the sides of the slabs typically have numerous transverse joints, often at intervals of every few feet. In cold climates such transverse joints may be formed having a thin expansion joint constructed of a felt-like material to permit expansion and contraction of adjacent slabs of the sidewalk without cracking. In other instances concrete slabs may be divided by strips of wood, such as 2×4's to provide an appearance which is usually considered more attractive than a large, undivided concrete slab. In any event, such dividing of large areas of concrete into smaller areas permits the settling of the slab without cracking, each smaller slab being permitted to move somewhat relative to the other slabs by the dividing boards. In the absence of being divided in this manner into smaller concrete areas, a large area concrete slab is prone to crack due to thermal expansion and contraction and ground settling. In some instances, as mentioned above, the transverse joints between adjacent concrete slabs may, instead of divider boards or expansion strips, simply be scored lines along which the concrete sidewalk may crack, for example, due to tree roots, ground subsidence or heavy traffic, without the slab otherwise cracking and becoming unattractive.

In any event, the rounding off of edges of concrete slabs at divider boards, expansion joints and the like, requires the edging tool to be used on both sides of the divider board and expansion strip, thereby doubling the amount of edging otherwise requires. It is, therefore, a principal objective of the present invention to provide a dual concrete edging tool apparatus by means of which an adjacent pair of edged of two adjoining concrete slabs may be rounded off at the same time. Moreover, the divider board or expansion strip may be utilized as a guide for the dual edging tool apparatus.

SUMMARY OF THE INVENTION:

In accordance with the present invention, there is provided a dual concrete edging tool apparatus which comprises first and second, generally conventional edging tools, each of which comprises a flat plate having a narrow edging lip depending therefrom; a frame; and means for mounting the first and second edging tools to the frame with the depending edging lips thereof in parallel opposition to one another. The mounting means include adjusting means for enabling the distance between the depending lips to be adjusted over a limited range, preferably between zero inches and at least about two inches, but preferably not more than about three inches.

In a preferred embodiment, the edging tool mounting means rigidly attaches one of the edging tools to the frame and the adjusting means adjustably connects the other edging tool to the frame. Preferable, the mounting means include a first angle iron longitudinally fixed to said first edging tool and a second angle iron longitudinally fixed to said second edging tool, each of said angle irons being in lieu of an edging tool handle. (The use of the generic term "angle iron" is not to be interpreted as limiting the angles used to being made of iron, as they may be made of other materials, such as stainless steel, tempered steel, aluminum or other metals.) Furthermore, the frame preferably comprises a rigid, flat plate, in which case, the edging tool mounting means include a third angle iron fixed to the under side of the plate adjacent one side edge thereof and the adjusting means include a fourth angle iron adjustably connected to the underside of the plate through at least one transverse slot in the plate, the first and second angle irons on the first and second edging tools being respectively attached to the third and fourth angle irons.

Preferably, the dual edging tool apparatus further includes an elongate operating handle and means for pivotally mounting the handle to upper regions of the plate in a generally central region thereof. Also, preferably, the apparatus includes edging tool back-up means for increasing the rigidity of the apparatus, the back-up means comprising a rigid transverse element mounted to the plate so as to be in contact with upper surfaces of both the first and second edging tools.

The two edging tools can be adjustably separated on the frame so that the depending lips are closely adjacent to a divider board or expansion strip, the pushing or the pulling of the apparatus along the divider board or expansion strip simultaneously rounding off the adjacent edges of the two concrete slabs abutting the board or strip. The apparatus is easy to adjust and easy to use and is relatively inexpensive to manufacture.

BRIEF DESCRIPTION OF THE DRAWINGS

The present invention can be more readily understood from a consideration of the following detailed description when taken in conjunction with the accompanying drawings, in which:

FIG. 1 is a perspective drawing of a dual concrete edging apparatus in accordance with the present invention, showing a first and second tool portion of the apparatus and showing a frame to which the two edging tools are attached, one of the tools being adjustably attached to the frame so that an edging distance between the two tools can be selectively varies;

FIG. 2 is a transverse cross sectional drawing taken along line 2—2 of FIG. 1 showing the manner in which the two edging tools are attached to the frame and showing the manner in which the apparatus is used to simultaneously edge both sides of a concrete slab dividing board;

FIG. 3 is a partial transverse cross-sectional drawing taken in the plane of FIG. 2, showing the two edging tools adjusted into an abutting relationship for the purpose of making an edging mark through a slab of concrete, there further being shown, in phantom lines, an adjustable one of the edging tools adjusted to a substantial separation distance, D, from the other edging tool; and FIG. 4 is a partial longitudinal cross sectional drawing taken along line 4—4 of FIG. 1 showing an edging tool back-up or stiffening means for adding rigidity to the edging tools.

In the various FIGS. like elements and features are given the same reference number and/or other identification.

DESCRIPTION OF THE PREFERRED EMBODIMENT

There is shown in FIG. 1, a dual concrete edging tool apparatus 10 in accordance with the present invention. As shown, and as more particularly described below, apparatus 10 comprises generally respective first and second edging tools 12 and 14, a frame 16, and edging tool mounting means 18 for mounting the two edging tools to the frame. Further comprising apparatus 10 are edging tool back-up means 20 and handle means 22, both the back-up means and the handle means being connected to frame 16.

Both first and second edging tools 12 and 14, respectively, may be made from commercially available edging tools or may be specially formed (that is, bent up) from a rectangle of heavy gauge sheet metal, for example, tempered steel. As such, first edging tool comprises a flat, wide leg 30 having a narrow depending lip or leg 32 along one side edge thereof (FIGS. 1 and 2). Wider leg 30 may, for example, be about four inches wide and may have a length, L, equal to about six to eight inches, or longer. The width of lip 32 may be about one-half inch. Lip 32 is bent at a radius, R, from leg 30, the radius, R, preferably being between about ¼ to about ½ inch.

Second edging tool 14 is constructed similarly to first edging tool 12, having a wide flat leg 34 and a narrow leg or lip 36 depending therefrom along one side edge. The radius, R (FIG. 2), between leg 34 and lip 36 is preferably the same as the radius, R, for first edging tool 12, that is, between about ¼ and about ½ inch.

In the event that first and second edging tools 12 and 14 are made from existing concrete edging tools, the handles normally found on the edging tools are removed.

Preferably, as shown in FIGS. 1 and 2, frame 16 comprises a rigid metal plate 40 which is approximately square in shape, for example, being about four to about six inches square. Edging tool mounting means comprise a first 90 degree angle iron 42 which is shorter than the length, L, of first edging tool leg 30 and which is fastened to an upper surface 44 thereof parallel to and relatively adjacent to lip 32. Angle iron 42 if formed having a first leg 46 directed away from lip 32 and which is welded or otherwise securely fastened to leg 30. A second leg 46 of first angle iron 42 extends upwardly from upper surface 44 (that is, in the opposite direction from lip 32). Mounting means 18 comprises a second 90 degree angle iron 50, which is similar to first angle iron 42 and which has a horizontal leg 52 which is welded or otherwise fastened to an upper surface 54 of second edging tool leg 34, and a vertical leg 56 which extends upwardly from leg 34. Second angle iron 50 is positioned on second edging tool 14 in a location similar to that of first angle iron 42 on first edging tool 12.

A third 90 degree angle iron 60, preferable similar in size to first and second angle irons 42 and 50, respectively is fixed, as by welding a first, horizontal leg 62 thereof, to an under surface 64 of plate 40, adjacent to a side edge 66 of the plate which extends over first edging tool 12 (FIGS. 1 and 2). A vertical leg 68 of third angle iron 62 extends, upon assembly, downwardly along the outside of vertical leg 48 of first angle iron 42. One or more bolts 70 and nuts 72 removably connect vertical legs 48 and 68 of respective first and third angle irons 42 and 62 together (FIG. 2).

Adjustable separation of lips 32 and 36 of respective first and second edging tools 12 and 14 is provided by adjustment means 74 which forms part of mounting means 18. Comprising adjustment means 74 is a fourth 90 degree angle iron 80 which is similar in size and shape to second angle iron 50. Fourth angle iron 80 is formed having respective vertical and horizontal legs 82 and 83. As shown in FIG. 2, vertical leg 82 of fourth angle iron 80 is detachably connected to vertical leg 56 of second angle iron 52 by one or more bolts and nuts 84 and 86, respectively. Instead of horizontal leg 83 of fourth angle iron 80 being fixed to under surface 64 of plate 40, the leg is adjustably fastened by to the plate by two bolts and wing nuts 90 and 92, respectively, the bolts being disposed through transverse slots 94 and 96 formed through the plate (FIGS. 1 and 2). Thus, by loosening wing nuts 92, the edging tool assembly comprising second edging tool 114 and second and fourth angle irons 50 and 80, can be slid toward or away from first edging tool 1 to vary the distance, D, between edging tool lips 32 and 34 (FIG. 2). As shown in FIG. 2, the distance, D, between edging lips 32 and 36 is adjusted to the width, W, of a board 100 which divides adjacent concrete slabs 102 and 104, respective edges 106 and 108 thereof which are to be rounded off by apparatus 10 (FIG. 1). Further in this regard, FIG. 3 depicts the adjustment range between edging lips 32 and 36 of edging tools 30 and 34, respectively. As indicated, second edging tool 34 can be adjusted on plate 40 from zero separation between edging lips 32 and 36, as is useful when only a scoring line is to be formed in a concrete slab, and a maximum separation distance, $D_{MAX}$, (for which edging tool 34 is shown in phantom lines)which is preferably at least about two inches and which may be three or more inches.

It is to be appreciated that although FIGS. 1 and 2 show only fourth angle 80 being adjustably attached to plate 40 (by means of bolts 90 through plate slots 94) and with third angle 60 being fixedly joined to the plate, that the third angle can alternatively be adjustable mounted to the plate in the same way the fourth angle is mounted thereto. If such adjustable mounting of third angle 60 to plate 40 is provided, either or both of edging tools 30 and 34 can be adjusted to provide the desired spacing, D, between the tools. In fact, such adjustable mounting of both third and fourth angles 60 and 80 to plate 40 enables adjustment of edging tools 30 and 34 so that the plate is centered over the separation between the two tools. However, proper alignment between tools 30 and 34 may be more difficult it both third and fourth angles 60 and 80 are adjustably mounted to plate 40 in the same manner.

As another alternative, third angle 60 can be adjustably mounted to plate 40 as shown in FIGS. 1 and 2 for fourth angle 80 and the fourth angle can be non-adjustably joined to the plate as shown in these FIGS. for the third plate. That is, either one or both of angles 60 and 80 may be adjustably mounted to plate 40 as presently shown for angle 60 so that either or both of edging tools may be adjusted to provide the desired spacing between the two tools.

Back-up support for edging tools 30 and 32 is preferably (but not necessarily) provided by back-up means 20 (FIGS. 1 and 4). As shown, back-up means 20 comprise an elongate transverse rod-like element or tubular member 110 which may, for example, be constructed from about a six inch length of small diameter pipe and which is rigidly fixed (as by welding), in a central region, to a tongue 112. Tongue 112 is, in turn, fastened by a bolt and nut 114 and 114 to a tab or ear 118 projecting forwardly and downwardly from plate 40 and forming a portion thereof. The dimensions of tongue 112 and tab 118, in combination with the angle, A, (FIG. 4) at which the tab projects downwardly, positions element 110 at upper surfaces 44 and 54 of respective edging tools 30 and 34 so as to provide stiffening to the edging tools and prevent or deduce the amount of flexing thereof when apparatus 10 is used.

Although plate 40 of apparatus 10 may be fitted with a hand-held handle in the manner of a conventional edging tool, it is preferred, as shown in FIGS. 1 and 2, to provide for the use of an elongate pole-type handle 120 which forms part of handle means 22. As best seen from FIG. 2, a lower end of handle 120 terminates in a fork end 122 which is pivotally fastened, by a bolt and nut 124 and 126, respectively, to an upwardly projecting leg 128 of an angle iron 130 which is fixed, as by welding, to an upper surface 132 of plate 40.

It is to be appreciated that the term "angle iron" as used herein is used in its generic sense, the material from which the angles 42, 50, 60, 80, and 130 are made not being limited, per se, to iron. As such, angle irons 42, 50, 60, 80, and 130 may be made of other rigid metals such as stainless steel or aluminum.

OPERATION OF APPARATUS 10

The operation of apparatus 10 is obvious from the above description. Nevertheless, a brief summary of the operation is provided. When the edging of two adjacent slabs of wet concrete (such as slabs 102 and 104, FIGS. 1 and 2, is required, wing nuts 92 on bolts 90 are loosened and the bolts are slid along slots 94 and 94 until the edging lips 32 and 36 of edging tools 31 and 34 are spaced the appropriate distance apart, for, example, a distance equal to the width , W, of board 100 which divided the two slabs. Apparatus 10 is set down on upper surfaces 140 and 142 of respective slaps 102 and 104 with edging lip 32 on one side of divider board 100 and edging lip 36 on the other side of the board. Apparatus 10 is then pushed and/or pulled, by handle 120, along slab surfaces 140 and 142 so as to round off concrete edges 106 and 108 (FIG. 1).

Although there is described above a specific arrangement of a dual concrete edging apparatus in accordance with the present invention for the purpose of illustrating the manner in which the invention can be used to advantage, it will be appreciated that the invention is not limited thereto. Accordingly, any and all variations and modifications which may occur to those skilled in the art are to be considered to be within the scope and spirit of the invention as defined in the appended claims.

What is claimed is:

1. A combination dual concrete edging tool and joint maker apparatus which comprises:

a. first and second edging tools, each edging tool comprising a flat plate having a depending edging lip, said edging lip being narrow as compared to the flat plate;

b. a frame comprising a rigid plate having dimensions substantially smaller than the flat plates of the first and second edging tools;

c. means for mounting said first and second edging tools to said frame with said depending edging lips in parallel opposition to one another, said mounting means including adjusting means for enabling a distance between said depending edging lips to be adjusted from zero in order that the tool apparatus can be used as a joint maker, to a distance selected to enable the tool apparatus to be used as a dual concrete edger; and d. edging tool back-up means for increasing the rigidity of the first and second edging tools, said back-up means including a rigid transverse element mounted to the frame rigid plate and extending therefrom in a position for contacting upper surfaces of both the first and second edging tools at a point distant from the frame.

2. The dual concrete edging tool apparatus as claimed in claim 1, wherein said mounting means rigidly attaches one of said edging tools to said frame, the adjusting means slideably connecting to other edging tool to the frame.

3. The dual concrete edging tool apparatus as claimed in claim 1, wherein said mounting means include a first angle iron longitudinally fixed to said first edging tool and a second angle iron longitudinally fixed to said second edging tool.

4. The dual concrete edging tool apparatus as claimed in claim 3, wherein said mounting means comprise a third angle iron fixed to the underside of the same rigid plate adjacent one side edge thereof and wherein said adjusting means includes a fourth angle iron adjustably connected to the underside of the rigid plate through at least one transverse slot in said plate, said first and second angle irons being respectively attached to said third and fourth angle irons.

5. The dual concrete edging tool apparatus as claimed in claim 1, including an elongate operating handle and means for pivotally mounting said handle to upper regions of said frame in a generally central region thereof.

6. A dual concrete edging tool apparatus which comprises:

a. first and second edging tools, each of said edging tools comprising a flat plate having a depending edging lip, said edging lip being narrow as compared to the flat plate;

b. a rigid plate;

c. fixed mounting means for fixing one of said first and second edging tools to the underside of said plate;

d. adjustable mounting means for adjustably attaching the other one of the first and second edging tools to the underside of the plate, the fixed and adjustable mounting means causing both of said edging tools to have their depending lips in parallel opposition with one another, said adjustable mounting means enabling the distance between said depending lips of the first and second edging tools to be adjustably varied from zero inches to at least about two inches; and edging tool back-up means for increasing the rigidity of the first and second edging tools, said back-up means including a rigid transverse element mounting to the frame rigid plate and extending therefrom in a position for contacting upper surfaces of both the first and second edging tools at a point distant from the frame.

7. The dual concrete edging tool apparatus as claim in claim 6, wherein said fixed mounting means comprises a first angle iron longitudinally fixed to an upper surface said first edging tool and said adjustable mounting means include a second angle iron longitudinally fixed to an upper surface said second edging tool, each of said first and second angle irons being in lieu of an edging tool handle.

8. The dual concrete edging tool apparatus as claimed in claim 7, wherein said fixed mounting means further include a third angle iron fixed to the under side of said plate adjacent one side edge thereof and wherein said adjustable mounting means further include a fourth angle iron adjustably connected to the underside of the plate through at least one transverse slot in said plate, said first and second angle irons being respectively attached to said third and fourth angle irons.

9. The dual concrete edging tool apparatus as claimed in claim 6, including an elongate operating handle and means for pivotally mounting said handle to upper regions of said frame in a generally central region thereof.

10. A dual concrete edging tool apparatus which comprises:

a. first and second edging tools, each of said edging tools comprising a flat plate having a depending edging lip, said edging lip being narrow as compared to the flat plate;

b. a rigid plate;

c. fixed mounting means for fixing one of said first and second edging tools to the underside of said plate;

d. adjustable mounting means for adjustably attached the other one of the first and second edging tools to the underside of the plate, the fixed and adjustable mounting means causing both of said edging tools to have their depending lips in parallel opposition with one another, said adjustable mounting means enabling the distance between said depending lips of the first and second edging tools to be adjustably varied from zero inches to at least about two inches; and e. edging tool back-up means for increasing the rigidity of the apparatus, said back-up means including a rigid transverse element mounted to said plate so as to be in contact with upper surfaces of both the first and second edging tool.

11. The dual concrete edging tool apparatus as claimed in claim 10, wherein said fixed mounting means comprises a first angle iron longitudinally fixed to an upper surface said first edging tool and said adjustable mounting means include a second angle iron longitudinally fixed to an upper surface said second edging tool, said fixed mounting means further including a third angle iron fixed to the underside of said plate adjacent one side edge thereof and said adjustable mounting means further including a fourth angle iron adjustably connected to the underside of the plate through at least one transverse slot in said plate, said first and second angle irons being respectively attached to said third and fourth angle irons.

12. The dual concrete edging tool apparatus as claimed in claim 10, including an elongate operating handle and means for pivotally mounting said handle to upper regions of said frame in a generally central region thereof.

* * * * *